US011415940B2

(12) United States Patent
Ihashi et al.

(10) Patent No.: US 11,415,940 B2
(45) Date of Patent: Aug. 16, 2022

(54) TIMEPIECE MOVEMENT AND TIMEPIECE

(71) Applicant: Seiko Instruments Inc., Chiba (JP)

(72) Inventors: Tomohiro Ihashi, Chiba (JP); Katsuya Mugishima, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 406 days.

(21) Appl. No.: 16/782,310

(22) Filed: Feb. 5, 2020

(65) Prior Publication Data

US 2020/0264561 A1 Aug. 20, 2020

(30) Foreign Application Priority Data

Feb. 15, 2019 (JP) ..... JP2019-025317

(51) Int. Cl.
*G04C 3/14* (2006.01)
*G04B 13/00* (2006.01)
*G04B 19/253* (2006.01)

(52) U.S. Cl.
CPC ..... *G04B 13/00* (2013.01); *G04B 19/25353* (2013.01); *G04C 3/14* (2013.01)

(58) Field of Classification Search
CPC .... G04B 13/00; G04B 19/25353; G04C 3/14; G04C 3/146; G04C 3/143
See application file for complete search history.

(56) References Cited

U.S. PATENT DOCUMENTS 8,319,468 B2 * 11/2012 Manaka ..... H02P 8/34 368/76
11,237,521 B2 * 2/2022 Kawata ..... G04C 3/143
2011/0286311 A1 * 11/2011 Ono ..... G04B 19/25353 368/38
2017/0322519 A1 * 11/2017 Lagorgette ..... G04C 3/14
2019/0121296 A1 * 4/2019 Ogasawara ..... G04C 3/14

FOREIGN PATENT DOCUMENTS

JP 3625395 12/2004
JP 5363167 9/2013

* cited by examiner

*Primary Examiner* — Sean Kayes
(74) *Attorney, Agent, or Firm* — Crowell & Moring LLP

(57) ABSTRACT

A timepiece movement includes a control unit that determines a position of an indicating hand by detecting a rotation state of a rotor, and a train wheel that transmits a drive force of a stepping motor to the indicating hand, and that has a first gear, and a second gear and a third gear which mesh with the first gear. The first gear has a reference load unit that causes fluctuations in a load applied to the rotor in each case of meshing with the second gear and the third gear. A first line segment which connects a center of the first gear and a center of the second gear to each other forms an angle smaller than 180° with a second line segment which connects the center of the first gear and a center of the third gear.

10 Claims, 11 Drawing Sheets

TIMEPIECE MOVEMENT AND TIMEPIECE

RELATED APPLICATIONS

This application claims priority to Japanese Patent Application No. 2019-025317 filed on Feb. 15, 2019, the entire content of which is incorporated herein by reference.

BACKGROUND OF THE INVENTION

1. Field of the Invention

An embodiment of the present invention relates to a timepiece movement and a timepiece.

2. Description of the Related Art

In a timepiece, as a method of detecting a position of an indicating hand, the following method is known, for example. A hole belonging to a gear configuring a train wheel is interposed between a light emitting element and a light receiving element so as to detect the position by determining the presence or absence of transmitted light.

A rotation state detection technique (for example, refer to Japanese Patent No. 5363167) has been proposed in which the indicating hand of the timepiece is driven using a drive pulse used for normal driving so as to detect a rotation state of a motor by using an induced voltage. According to the invention disclosed in Japanese Patent No. 5363167, in a case where the position is detected as a non-rotation state by using the detection method, an indicating hand operation is realized using an auxiliary drive pulse so as to add a rotational force to the indicating hand operation.

Furthermore, the following technique (for example, refer to Japanese Patent No. 3625395) has been proposed. In a case where a control unit of the timepiece detects a predetermined high load corresponding to a reference position of the indicating hand, the control unit determines the high load as the reference position. According to the invention disclosed in Japanese Patent No. 3625395, the control unit determines the reference position in response to a state where the auxiliary drive pulse is output.

SUMMARY OF THE INVENTION

Incidentally, as an example of a mechanism for generating a predetermined load corresponding to a reference position of an indicating hand in a motor, a method has been developed as follows. One tooth of a predetermined gear that rotates in conjunction with the indicating hand is formed in a shape which is different from that of other teeth. In this manner, load fluctuations occur in the motor when the one tooth meshes with other gear.

However, in a case where the predetermined gear meshes with a plurality of the gears, the one tooth meshes with the other gear multiple times while the predetermined gear rotates one round. Therefore, the motor receives the load fluctuations multiple times while the predetermined gear rotates one round. Consequently, in some cases, the reference position of the indicating hand may be less likely to be detected.

Therefore, an embodiment according to the present invention aims to provide a timepiece movement and a timepiece which can detect the reference position of the indicating hand.

According to an embodiment of the present invention, there is provided a timepiece movement including a stepping motor that has a rotor for rotating an indicating hand, a control unit that rotates the rotor by using a main drive pulse and an auxiliary drive pulse, and that determines a reference position of the indicating hand by detecting a rotation state of the rotor when the indicating hand is rotated using a detection drive pulse based on the main drive pulse, and a train wheel that transmits a drive force of the stepping motor to the indicating hand, and that has a first gear, and a second gear and a third gear which mesh with the first gear. The first gear has a reference load unit that causes fluctuations in a load applied to the rotor in each case where the first gear meshes with the second gear and the third gear. A first line segment which connects a rotation center of the first gear and a rotation center of the second gear to each other in a plan view is set to form an angle smaller than 180° with a second line segment which connects the rotation center of the first gear and a rotation center of the third gear to each other in a plan view.

According to the embodiment of the present invention, the number of drive steps of the stepping motor which is required for the reference load unit to move from a position for meshing with the second gear to a position for meshing with the third gear is different from the number of drive steps of the stepping motor which is required for the reference load unit to move from the position for meshing with the third gear to the position for meshing with the second gear. Therefore, the stepping motor is driven one step by one step so as to determine a length of a period during which the load applied to the rotor does not fluctuate. In this manner, it is possible to detect a position where the reference load unit meshes with the second gear and a position where the reference load unit meshes with the third gear. Accordingly, a position of the indicating hand can be detected by associating a rotation position of the reference load unit and the reference position of the indicating hand with each other.

The timepiece movement may further include an intermittent operation unit that intermittently operates the first gear to rotate by rotating the rotor. The intermittent operation unit may cause at least one fluctuation in the load applied to the rotor each time the first gear rotates once. The at least one fluctuation may occur in a portion of a period during which the reference load unit is located in a region interposed between the first line segment and the second line segment in a plan view.

According to the embodiment of the present invention, the load applied to the rotor does not fluctuate while the reference load unit passes through the outside of the region interposed between the first line segment and the second line segment in a plan view. The first gear is rotated 180° or larger while the reference load unit passes through the outside of the region interposed between the first line segment and the second line segment in a plan view. Therefore, even if the first gear is rotated 180° or larger, a state where the load applied to the rotor does not fluctuate is determined. In this manner, the fluctuations in the load applied to the rotor when the reference load unit enters the region interposed between the first line segment and the second line segment in a plan view can be easily detected by being distinguished from the fluctuations of the load applied to the rotor when the reference load unit retreats from the region interposed between the first line segment and the second line segment in a plan view and the fluctuations in the load applied to the rotor by an operation of the intermittent operation unit. Therefore, it is possible to detect the reference position of the indicating hand.

In the timepiece movement, the intermittent operation unit may include a date indicator that performs a date changing operation.

In general, the date indicator performs the date changing operation only before and after a time at which a date is changed. Accordingly, the load may intermittently fluctuate in the rotor of the stepping motor that drives the date indicator. Therefore, according to the embodiment of the present invention, the above-described operation effects can be effectively achieved.

In the timepiece movement, a central angle of a region interposed between the first line segment and the second line segment in a plan view may be larger than a rotation angle of the first gear during a period during which the at least one fluctuation occurs.

According to the embodiment of the present invention, it is possible to prevent the fluctuations in the load applied to the rotor by the operation of the intermittent operation unit from overlapping the fluctuations in the load applied to the rotor by the reference load unit. Accordingly, it is possible to accurately detect the fluctuations in the load applied to the rotor by the reference load unit.

In the timepiece movement, the central angle of the region interposed between the first line segment and the second line segment in a plan view may be larger than a sum of the rotation angle of the first gear during the period during which at least one fluctuation occurs and a rotation angle corresponding to two teeth of the first gear.

According to the embodiment of the present invention, when the train wheel is assembled, a meshing position between the first gear and at least one of the second gear and the third gear can be allowed to be shifted one tooth from a desired meshing position. Accordingly, it is possible to easily assemble the timepiece movement which can achieve the above-described operation effects.

In the timepiece movement, the control unit may detect a position of the reference load unit, based on the fluctuations of the load applied to the rotor when the reference load unit enters a region interposed between the first line segment and the second line segment in a plan view.

According to the embodiment of the present invention, a length of a period during which the load applied to the rotor does not fluctuate is determined. In this manner, the fluctuations in the load applied to the rotor when the reference load unit of the first gear enters the region interposed between the first line segment and the second line segment in a plan view can be easily detected by being distinguished from the fluctuations of the load applied to the rotor when the reference load unit retreats from the region. Accordingly, the reference position of the indicating hand can be detected by associating the rotation position of the reference load unit and the reference position of the indicating hand with each other.

The timepiece movement may further include a storage unit that stores information on a position of the indicating hand when the reference load unit causes the fluctuations in the load applied to the rotor.

According to the embodiment of the present invention, the control unit detects the position of the reference load unit by detecting the fluctuations in the load applied to the rotor. In this manner, based on the information stored in the storage unit, to the control unit can detect the position of the indicating hand.

In the timepiece movement, based on the information on the position of the indicating hand which is stored in the storage unit, the control unit may detect a position indicated by the indicating hand when the fluctuations in the load applied to the rotor are detected.

According to the embodiment of the present invention, it is possible to recognize the position indicated by the indicating hand. Therefore, the indicating hand can be moved to a desired position.

In the timepiece movement, based on the information on the position of the indicating hand which is stored in the storage unit, the control unit may move the indicating hand to a position indicating 0 o'clock.

According to the embodiment of the present invention, it is possible to accurately perform a resetting operation of the indicating hand.

According to an embodiment of the present invention, there is provided a timepiece including the timepiece movement.

According to the embodiment of the present invention, the timepiece includes the timepiece movement capable of detecting the reference position of the indicating hand. Therefore, it is possible to prevent misalignment of the indicating hand.

DETAILED DESCRIPTION OF THE PREFERRED EMBODIMENTS

Figure 1:
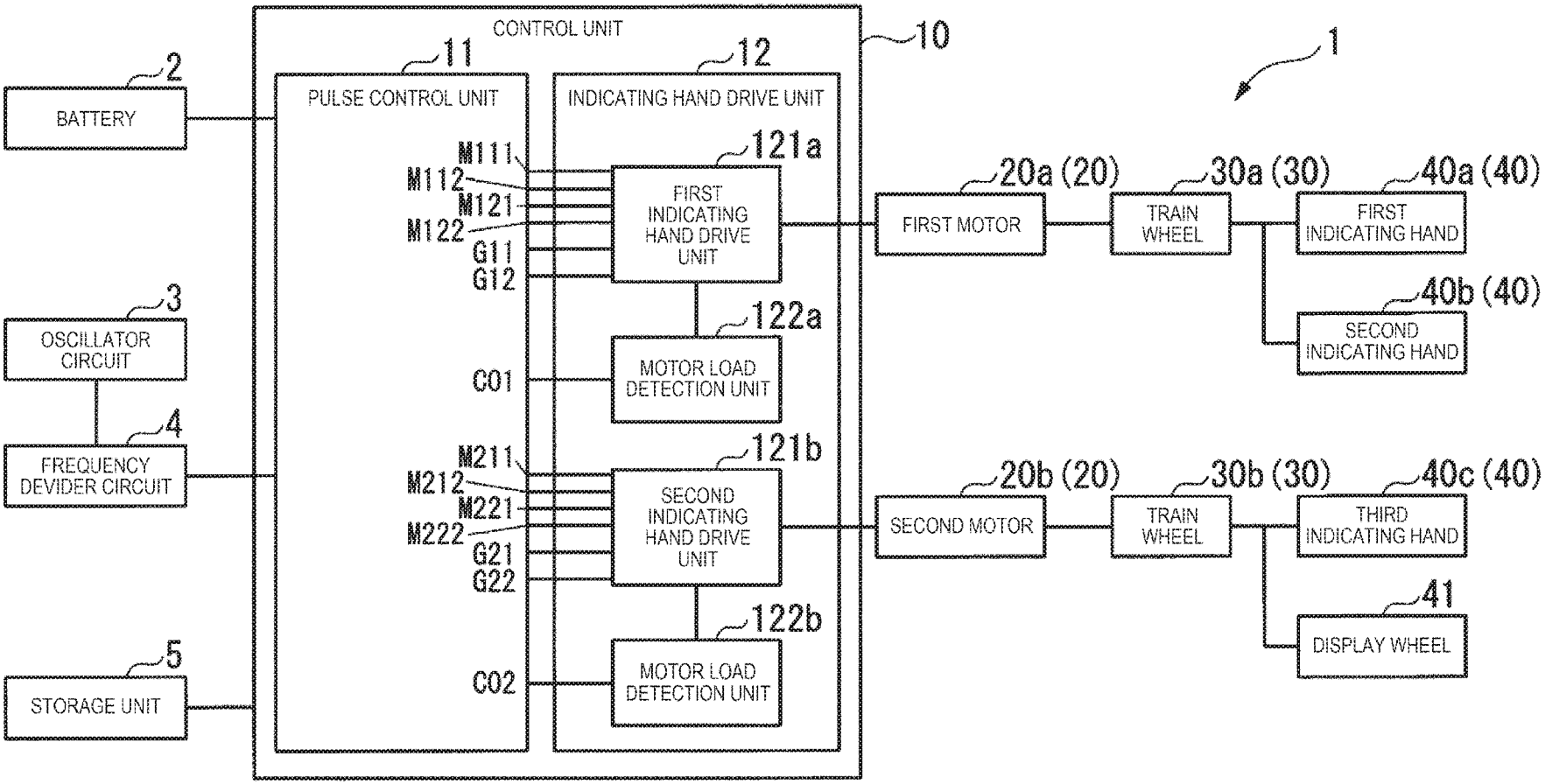
FIG. 1 is a block diagram illustrating a configuration example of a timepiece according to an embodiment.

Hereinafter, embodiments according to the present invention will be described with reference to the drawings. In the following description, the same reference numerals will be given to configurations having the same or similar function. Repeated description of the configurations may be omitted in some cases.

FIG. 1 is a block diagram illustrating a configuration example of a timepiece according to an embodiment.

As illustrated in FIG. 1, a timepiece 1 includes a battery 2, an oscillator circuit 3, a frequency divider circuit 4, a storage unit 5, a control unit 10, a first motor 20*a*, a second motor 20*b*, a train wheel 30*a*, a train wheel 30*b*, a first indicating hand 40*a*, a second indicating hand 40*b*, a third indicating hand 40*c*, and a display wheel 41 (intermittent operation unit).

The control unit 10 includes a pulse control unit 1 and an indicating hand drive unit 12.

The indicating hand drive unit 12 includes a first indicating hand drive unit 121*a*, a motor load detection unit 122*a*, a second indicating hand drive unit 121*b*, and a motor load detection unit 122*b*.

A timepiece movement includes the at least storage unit 5, the control unit 10, the first motor 20*a*, the second motor 20*b*, the train wheel 30*a*, the train wheel 30*b*, and the display wheel 41.

In a case where one of the first motor 20*a* and the second motor 20*b* is not specified, both of these will be collectively referred to as a motor 20. In a case where one of the train wheel 30*a* and the train wheel 30*b* is not specified, both of these will be collectively referred to as a train wheel 30. In a case where one of the first indicating hand 40*a*, the second indicating hand 40*b*, and the third indicating hand 40*c* is not specified, all of these will be collectively referred to as an indicating hand 40. In a case where one of the first indicating hand drive unit 121*a* and the second indicating hand drive unit 121*b* is not specified, both of these will be collectively referred to as an indicating hand drive unit 121. In a case where one of the motor load detection unit 122*a* and the motor load detection unit 122*b* is not specified, both of these will be collectively referred to as a motor load detection unit 122.

The timepiece 1 illustrated in FIG. 1 is an analog timepiece which displays a measured time by using the indicating hand 40 and displays a date corresponding to the measured time by using the display wheel 41. In the example illustrated in FIG. 1, the timepiece 1 includes three indicating hands 40. However, the number of the indicating hands 40 may be one, two, four, or more.

For example, the battery 2 is a lithium battery or a silver oxide battery, which is a so-called button battery. The battery 2 may be a solar battery and a storage battery for storing power generated by the solar battery. The battery 2 supplies the power to the control unit 10.

For example, the oscillator circuit 3 is a passive element used in order to oscillate a predetermined frequency from mechanical resonance thereof by utilizing a piezoelectric phenomenon of a crystal. Here, the predetermined frequency is 32 kHz, for example.

The frequency divider circuit 4 divides a signal having the predetermined frequency output by the oscillator circuit 3 into a desired frequency, and outputs the divided signal to the control unit 10.

The storage unit 5 stores a drive pulse for respectively driving the first indicating hand 40*a*, the second indicating hand 40*b*, the third indicating hand 40*c*, and the display wheel. The drive pulse will be described later. The storage unit 5 stores data in association with a combination of an output of a comparator Q7 (refer to FIG. 2) included in the motor load detection unit 122 in sections T1 to T3, a rotation state, and a state of the motor 20. The sections T1 to T3 will be described later with reference to FIG. 6. The storage unit 5 stores a program used for controlling by the control unit 10 or information on a rotation position of the indicating hand (to be described later).

The control unit 10 measures the time by using a desired frequency divided by the frequency divider circuit 4, and drives the motor 20 so that the indicating hand 40 is operated in response to a time measurement result. The control unit 10 detects a reverse voltage (induced voltage) generated by the rotation of the motor 20, and detects a reference position of the indicating hand 40, based on a detected result. A method for detecting the reference position will be described later.

The pulse control unit 11 measures the time by using the desired frequency divided by the frequency divider circuit 4, generates a pulse signal so as to operate the indicating hand 40 in response to the time measurement result, and outputs the generated pulse signal to the indicating hand drive unit 12. The pulse control unit 11 acquires a comparison result between the induced voltage generated in the motor 20 which is detected by the indicating hand drive unit 12 and a reference voltage. Based on an acquired result, the pulse control unit 11 detects the reference position.

In the pulse control unit 11, a drive terminal M111, a drive terminal M112, a drive terminal M121, a drive terminal M122, a control terminal G11, and a control terminal G12 are connected to the first indicating hand drive unit 121*a*. A detection terminal CO1 is connected to the motor load detection unit 122*a*. A drive terminal M211, a drive terminal M212, a drive terminal M221, a drive terminal M222, a control terminal G21, and a control terminal G22 are connected to the second indicating hand drive unit 121*b*. A detection terminal CO2 is connected to the motor load detection unit 122*b*.

The indicating hand drive unit 12 drives the motor 20 in response to the pulse signal output by the pulse control unit 11, thereby operating the indicating hand 40. The indicating hand drive unit 12 detects the induced voltage generated when the motor 20 is driven, and outputs the comparison result between the detected induced voltage and the reference voltage to the pulse control unit 11.

The first indicating hand drive unit 121*a* generates the pulse signal for rotating the first motor 20*a* forward or rearward in accordance with the control of the pulse control unit 11. The first indicating hand drive unit 121*a* drives the first motor 20*a* by using the generated pulse signal.

The second indicating hand drive unit 121*b* generates the pulse signal for rotating the second motor 20*b* forward or rearward in accordance with the control of the pulse control unit 11. The second indicating hand drive unit 121*b* drives the second motor 20*b* by using the generated pulse signal.

The motor load detection unit 122*a* detects the reverse voltage generated in the first indicating hand drive unit 121*a* by the rotation of the first motor 20*a*, compares the detected reverse voltage with a reference voltage Vcomp which is a threshold value, and outputs the comparison result to the pulse control unit 11.

The motor load detection unit 122*b* detects the reverse voltage generated in the second indicating hand drive unit 121*b* by the rotation of the second motor 20*b*, compares the detected reverse voltage with the reference voltage Vcomp which is the threshold value, and outputs the comparison result to the pulse control unit 11.

The first motor 20*a* and the second motor 20*b* are respectively stepping motors. The first motor 20*a* drives the first indicating hand 40*a* and the second indicating hand 40*b* via the train wheel 30*a* by using the pulse signal output by the first indicating hand drive unit 121*a*. The second motor 20*b* drives the third indicating hand 40*c* and the display wheel 41 via the train wheel 30*b* by using the pulse signal output by the second indicating hand drive unit 121*b*.

The train wheel 30*a* and the train wheel 30*b* respectively have at least one gear. The train wheel 30*a* transmits a drive force of the first motor 20*a* to the first indicating hand 40*a* and the second indicating hand 40*b*. The train wheel 30*b* transmits a drive force of the second motor 20*b* to the third indicating hand 40*c* and the display wheel 41. A gear belonging to the train wheel 30 has a reference load unit 39 (refer to FIG. 8). The reference load unit 39 is configured to cause fluctuations in a load (torque) applied to a rotor 202 when the indicating hand 40 is located at the reference position. Hereinafter, the load applied to the rotor 202 will be referred to as a drive load. In the present embodiment, when the indicating hand 40 is located at the reference position, the drive load increases due to the reference load unit 39. For example, the reference load unit 39 is configured so that one tooth of a gear has a shape different from that of other teeth. A detailed configuration of the train wheel 30 will be described later.

The first indicating hand 40*a* is a second hand. The second indicating hand 40*b* is a minute hand. The third indicating hand 40*c* is an hour hand. The display wheel 41 is a date indicator. The first indicating hand 40*a*, the second indicating hand 40*b*, the third indicating hand 40*c*, and the display wheel 41 are respectively supported so as to be rotatable by a support body (not illustrated).

Next, a configuration example of the indicating hand drive unit 121 and the motor load detection unit 122 will be described.

Figure 2:
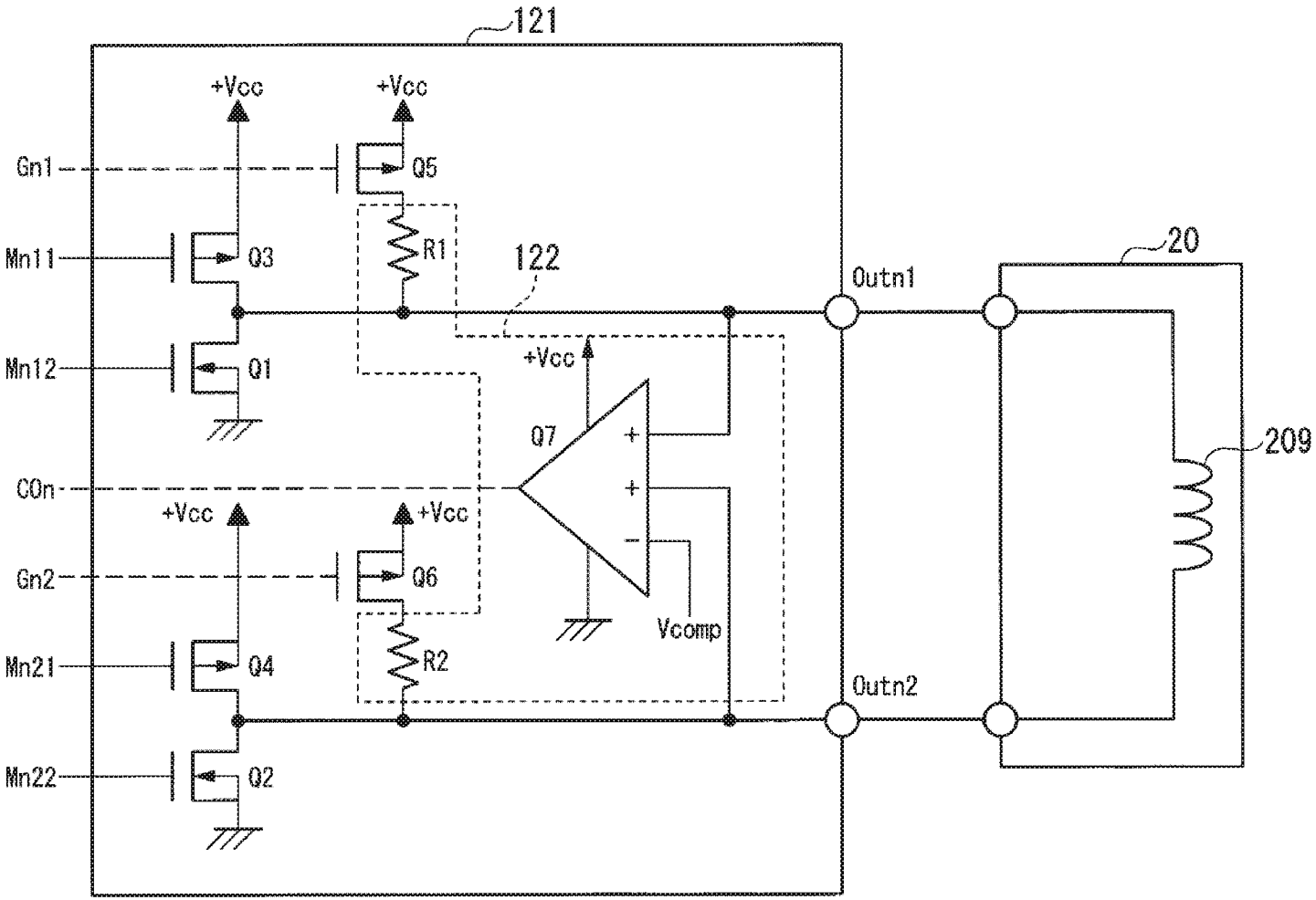
FIG. 2 is a block diagram illustrating a configuration example of an indicating hand drive unit and a motor load detection unit according to the embodiment.

FIG. 2 is a block diagram illustrating the configuration example of the indicating hand drive unit and the motor load detection unit according to the embodiment.

As illustrated in FIG. 2, the indicating hand drive unit 121 includes switching elements Q1 to Q6. The motor load detection unit 122 includes resistors R1 and R2 and the comparator Q7.

In the switching element Q3, a gate is connected to a drive terminal Mn11 (n is 1 or 2) of the pulse control unit 11, a source is connected to a power source +Vcc, and a drain is connected to a drain of the switching element Q1, one end of the resistor R1, a first input portion (+) of the comparator Q7, and a first output terminal Outn1.

In the switching element Q1, a gate is connected to a drive terminal Mn12 of the pulse control unit 11, and a source is grounded.

In the switching element Q5, a gate is connected to a control terminal Gn1 of the pulse control unit 11, a source is connected to the power source +Vcc, and a drain is connected to the other end of the resistor R1.

In the switching element Q4, a gate is connected to a drive terminal Mn21 of the pulse control unit 11, a source is connected to the power source +Vcc, and a drain is connected to a drain of the switching element Q2, one end of the resistor R2, a second input portion (+) of the comparator Q7, and a second output terminal Outn2.

In the switching element Q2, a gate is connected to a drive terminal Mn22 of the pulse control unit 11, and a source is grounded.

In the switching element Q6, a gate is connected to a control terminal Gn2 of the pulse control unit 11, a source is connected to the power source +Vcc, and a drain is connected to the other end of the resistor R2.

In the comparator Q7, the reference voltage Vcomp is supplied to a third input portion (−), and an output portion is connected to a detection terminal COn of the pulse control unit 11.

The motor 20 is connected to both ends of the first output terminal Outn1 and the second output terminal Outn2 of the indicating hand drive unit 121.

For example, each of the switching elements Q3, Q4, Q5, and Q6 is a P-channel field effect transistor (FET). For example, each of the switching elements Q1 and Q2 is an N-channel FET.

The switching elements Q1 and Q2 are configuration elements for driving the motor 20. The switching element Q5 and Q6, and the resistor R1 and the resistor R2 are configuration elements for detecting the rotation. The switching element Q3 and Q4 are configuration elements used for both driving the motor 20 and detecting the rotation of the motor 20. The switching elements Q1 to Q6 are respectively low impedance elements having low ON-resistance in an ON-state. Resistance values of the resistors R1 and R2 are the same as each other, and are greater than a value of the ON-resistance of the switching element.

The indicating hand drive unit 121 brings the switching elements Q1 and Q4 into an ON-state at the same time, and brings the switching elements Q2 and Q3 into an OFF-state at the same time. In this manner, the indicating hand drive unit 121 supplies an electric current flowing in a forward direction to a drive coil 209 included in the motor 20, thereby rotationally driving the motor 20 by 180° in the forward direction. The indicating hand drive unit 121 brings the switching elements Q2 and Q3 into the ON-state at the same time, and brings the switching elements Q1 and Q4 into the OFF-state at the same time. In this manner, the indicating hand drive unit 121 supplies the electric current flowing in a rearward direction to the drive coil 209, thereby rotationally driving the motor 20 by further 180° in the forward direction.

Next, an example of a drive signal output by the pulse control unit 11 will be described.

Figure 3:
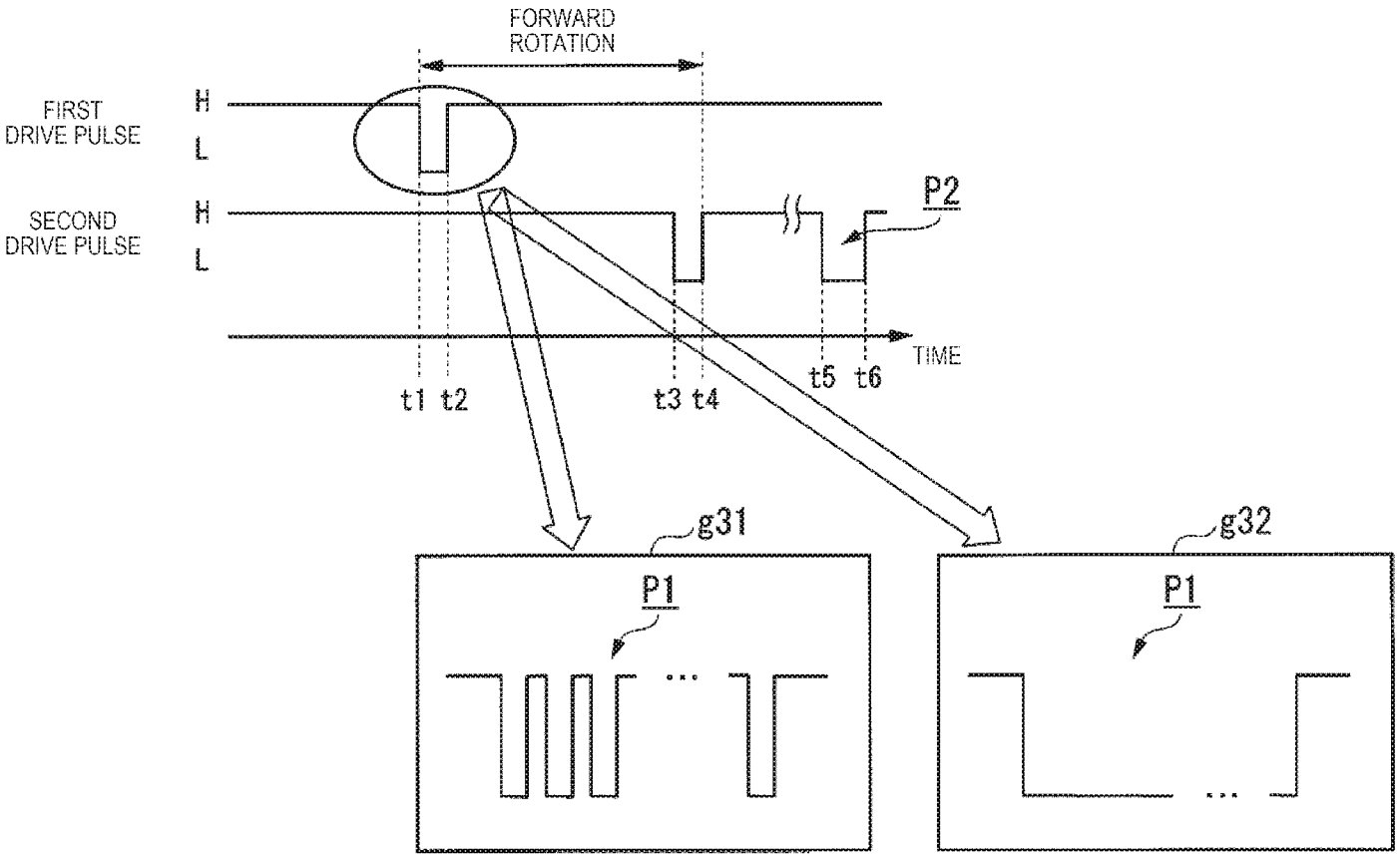
FIG. 3 is a view illustrating an example of a drive pulse output by a pulse control unit according to the embodiment.

FIG. 3 is a view illustrating an example of the drive pulse output by the pulse control unit according to the embodiment.

In FIG. 3, a horizontal axis represents a time, and a vertical axis represents whether the signal is in an H (high) level or in an L (low) level. A waveform P1 is a waveform of a first drive pulse. A waveform P2 is a waveform of a second drive pulse.

During a period of times t1 to t6, the motor 20 is rotated forward. During a period of times t1 to t2, the pulse control unit 11 generates a first drive pulse Mn1. During a period of times t3 to t4, the pulse control unit 11 generates a second drive pulse Mn2. The drive signal generated during the period of times t1 to t2 or the period of times t3 to t4 is configured to include a plurality of pulse signals as in a region indicated by a reference numeral g31, and the pulse control unit 11 adjusts a pulse duty. In this case, the period of times t1 to t2 or the period of times t3 to t4 is changed in accordance with the pulse duty. Hereinafter, in the present embodiment, a signal wave of the region indicated by the reference numeral g31 will be referred to as a "comb tooth wave". The drive signal generated during the period of times t1 to t2 or the period of times t3 to t4 is configured to include one pulse signal as in the region indicated by a reference numeral g32, and the pulse control unit 11 adjusts a pulse width. In this case, the period of times t1 to t2 or the period of times t3 to t4 is changed in accordance with the pulse width. Hereinafter, in the present embodiment, a signal wave of the region indicated by the reference numeral g32 will be referred to as a "rectangular wave".

In the present embodiment, a pulse generated during the period of times t1 to t2 or the period of times t3 to t4 will be referred to as a main drive pulse (detection drive pulse) P1. A pulse generated during a period of times t5 to t6 is an auxiliary drive pulse P2 to be output only when it is detected that the rotor 202 is not rotated by the main drive pulse P1. In the following description, an example will be described in which the main drive pulse P1 is the comb tooth wave.

Next, a configuration example of the motor 20 will be described.

Figure 4:
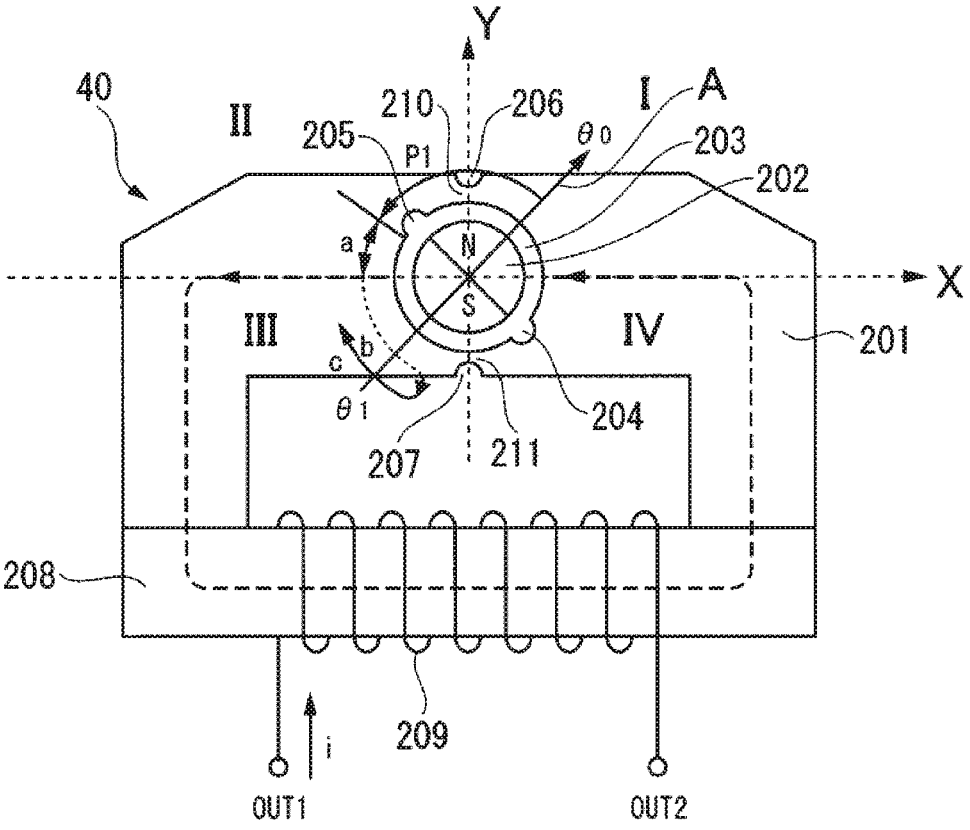
FIG. 4 is a view illustrating a configuration example of a motor according to the embodiment.

FIG. 4 is a view illustrating the configuration example of the motor 20 according to the embodiment.

As illustrated in FIG. 4, in a case where the motor 20 is used for an analog electronic timepiece, a stator 201 and a magnetic core 208 are fixed to a main plate (not illustrated) by a screw (not illustrated), and are joined to each other. The drive coil 209 has a first terminal OUT1 and a second terminal OUT2.

The rotor 202 is magnetized in two poles (south pole and north pole). A pinion (not illustrated) is disposed in the rotor 202.

The stator 201 is formed of a magnetic material. An outer end portion of the stator 201 is provided with a plurality of (two in the present embodiment) cutout portions (outer notches) 206 and 207 disposed at positions facing each other across a rotor accommodating through-hole 203. Saturable portions 210 and 211 are disposed between the respective outer notches 206 and 207 and the rotor accommodating through-hole 203.

The saturable portions 210 and 211 are not magnetically saturated by a magnetic flux of the rotor 202, and are configured so that magnetic resistance increases after being magnetically saturated when the drive coil 209 is excited. The rotor accommodating through-hole 203 is configured to have a circular hole shape in which a plurality of (two in the present embodiment) crescentic cutout portions (inner notches) 204 and 205 are integrally formed in facing portions of a through-hole having a circular contour.

The cutout portions 204 and 205 configure a positioning portion for determining a stop position of the rotor 202. In a state where the drive coil 209 is not excited, the rotor 202 is located at a position corresponding to the positioning portion as illustrated in FIG. 4. In other words, the rotor 202 is stably stopped at a position (position of an angle $\theta_0$) where a magnetic pole axis A of the rotor 202 is perpendicular to a line segment connecting the cutout portions 204 and 205 to each other. An XY-coordinate space centered on a rotation axis (rotation center) of the rotor 202 is divided into four quadrants (first quadrant I to fourth quadrant IV).

Here, the main drive pulse P1 having the rectangular wave is supplied from the indicating hand drive unit 121 to between the terminals OUT1 and OUT2 of the drive coil 209 (for example, the first terminal OUT1 side is set to a cathode, and the second terminal OUT2 side is set to an anode). If a drive current i flows in a direction indicated by an arrow in FIG. 4, a magnetic flux is generated in the stator 201 in a direction indicated by a broken arrow. In this manner, the saturable portions 210 and 211 are saturated, and the magnetic resistance increases. Thereafter, due to interaction between the magnetic pole generated in the stator 201 and the magnetic pole of the rotor 202, the rotor 202 is rotated 180° in the direction indicated by the arrow in FIG. 4, and is stably stopped at a position where the magnetic pole axis shows an angle $\theta_1$. That is, the motor 20 rotates the rotor 202 by 180° in one step. A rotation direction (counterclockwise direction in FIG. 4) for allowing a normal operation (indicating hand operation since the present embodiment employs the analog electronic timepiece) to be performed by rotationally driving the motor 20 will be referred to as a forward direction, and a direction opposite thereto (clockwise direction in FIG. 4) will be referred to as a rearward direction.

If the drive current i flows in a direction opposite to the arrow in FIG. 4 by supplying the main drive pulse P1 having the rectangular wave of the opposite polarity from the indicating hand drive unit 121 to the terminals OUT1 and OUT2 of the drive coil 209 (the first terminal OUT1 side is set to the anode, and the second terminal OUT2 side is set to the cathode so as to have the opposite polarity compared to the precedent driving), the magnetic flux is generated in the stator 201 in the direction opposite to the broken arrow. In this manner, the saturable portions 210 and 211 are first saturated. Thereafter, due to the interaction between the magnetic pole generated in the stator 201 and the magnetic pole of the rotor 202, the rotor 202 is rotated 180° in the same direction (forward direction), and is stably stopped at a position where the magnetic pole axis shows the angle $\theta_0$.

Thereafter, in this way, the indicating hand drive unit 121 supplies a signal (alternating signal) having different polarity to the drive coil 209. In this manner, the motor 20 repeatedly performs the operation. A configuration is adopted in which the rotor 202 can be continuously rotated every 180° in the direction of the arrow.

The indicating hand drive unit 121 rotationally drives the motor 20 by alternately driving the motor 20 by using the main drive pulse P1 having mutually different polarities. In a case where the motor 20 cannot be rotated using the main drive pulse P1, the motor 20 is rotationally driven using the auxiliary drive pulse P2 having the polarity the same as the polarity of the main drive pulse P1 after a section T3 (to be described later).

Next, an operation of the switching elements Q1 to Q6 when the motor 20 is driven and an example of the induced voltage generated when the motor is rotated will be described. In the following example, a case where the motor 20 is rotated forward will be described.

Figure 5:
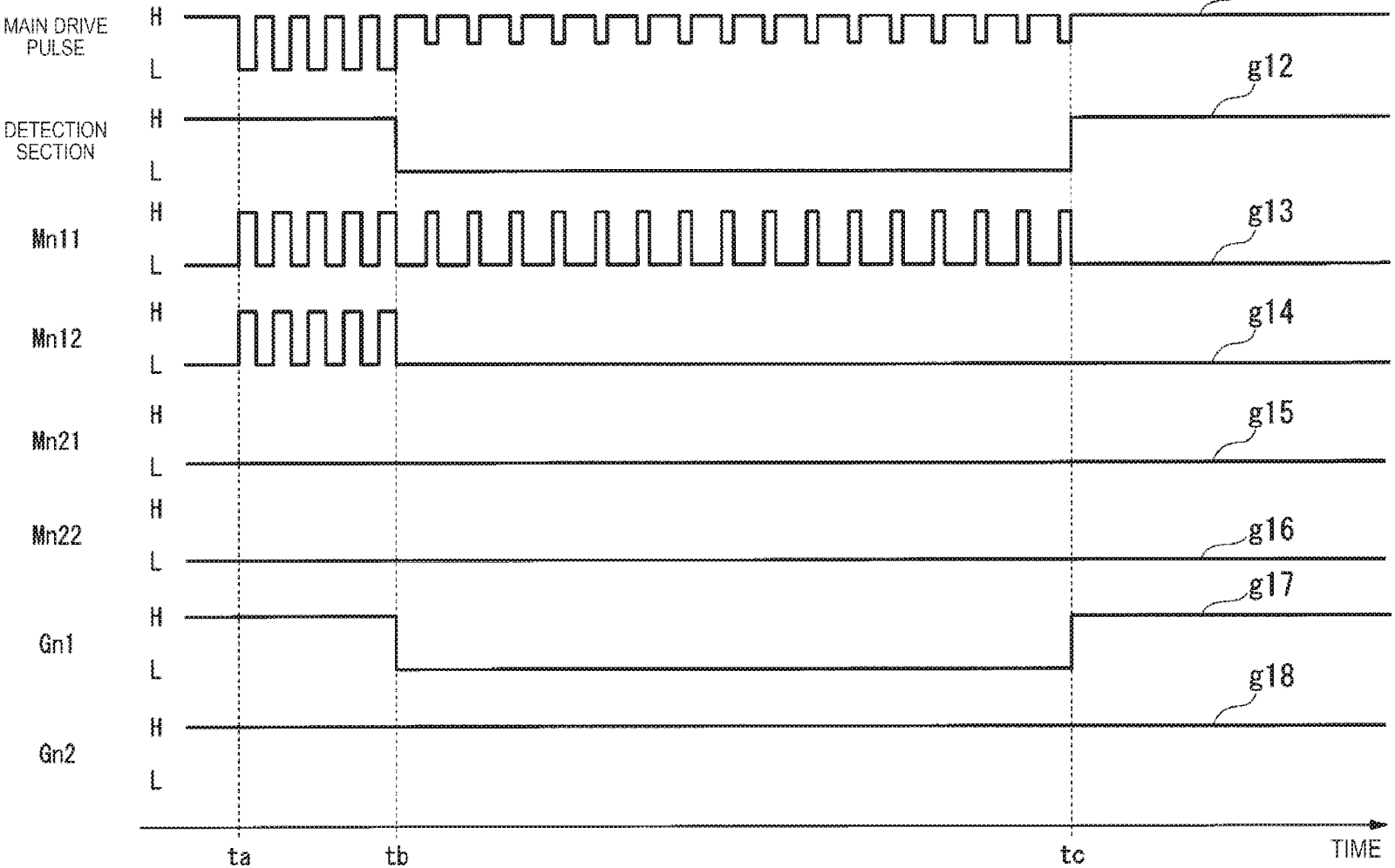
FIG. 5 is a view illustrating an example of a main drive pulse and an induced voltage generated when the motor is rotated according to the embodiment.

FIG. 5 is a view illustrating an example of the main drive pulse P1 and the induced voltage generated when the motor is rotated according to the embodiment. In FIG. 5, the horizontal axis represents a time, and the vertical axis represents whether the signal is in an H-level or in an L-level. A waveform g11 is a waveform of the main drive pulse P1 and the detection pulse which are output from the first output terminal Outn1 of the indicating hand drive unit 121. A waveform g12 indicates a detection section. A waveform g13 is a waveform of a control signal Mn11 input to the gate of the switching element Q3. A waveform g14 is a waveform of a control signal Mn12 input to the gate of the switching element Q1. A waveform g15 is a waveform of a control signal Mn21 input to the gate of the switching element Q4. A waveform g16 is a waveform of a control signal Mn22 input to the gate of the switching element Q2. A waveform g17 is a waveform of a control signal Gn1 input to the gate of the switching element Q5. A waveform g18 is a waveform of a control signal Gn2 input to the gate of the switching element Q6.

A state illustrated in FIG. 5 represents a state during the period of times t1 to t3 in FIG. 3.

In FIG. 5, the switching elements Q3, Q4, Q5, and Q6 are brought into the ON-state during the period in which the signal input to the gate is in the L-level, and are brought into the OFF-state during the period in which the signal input to the gate is in the H-level. The switching elements Q1 and Q2 are brought into the ON-state during the period in which the signal input to the gate is in the H-level, and are brought into the OFF-state during the period in which the signal input to the gate is in the L-level.

A period of times ta to tb represents a drive section.

A period of times tb to tc represents a detection section in a rotation state.

During the period of times ta to tb representing the drive section, as illustrated by the waveform g13 and the waveform g14, the pulse control unit 1 switches the switching elements Q3 and Q1 between the ON-state and the OFF-state at a predetermined cycle in response to the main drive pulse P1 having the comb tooth wave. In this manner, the pulse control unit 11 controls the motor 20 to be rotated in the forward direction. In a case where the motor 20 is normally rotated, the rotor included in the motor 20 is rotated 180° in the forward direction. During this period, the switching element Q2, Q5, and Q6 are respectively in the OFF-state, and the switching element Q4 is in the ON-state.

During the period of times tb to tc representing the detection section, the pulse control unit 11 maintains the OFF-state of the switching element Q1, switches the switching element Q3 between the ON-state and the OFF-state at a predetermined timing, and controls the switching element Q3 to be in a high-impedance state. In this detection section, the pulse control unit 11 controls the switching element Q5 to be switched to the ON-state. During the detection period, the pulse control unit 11 maintains the on-state of the switching element Q4, and controls the switching elements Q2 and Q6 to be switched to the OFF-state.

In this manner, in the detection section, a detection loop in which the switching elements Q4 and Q5 are in the ON-state and the switching element Q3 is in the OFF-state, and a closed loop in which the switching elements Q4 and Q5 are in the ON-state and the switching element Q3 is in the ON-state are alternately repeated at a predetermined cycle. In this case, in a state of the detection loop, the loop is configured to include the switching elements Q4 and Q5 and the resistor R1. Accordingly, the motor 20 is not braked. On the other hand, in a state of the closed loop, the loop is configured to include the switching elements Q3 and Q4 and the drive coil 209 belonging to the motor 20. In this manner, the drive coil 209 is short-circuited. Accordingly, the motor 20 is braked, and free vibration of the motor 20 is suppressed.

In the detection section, the induced current flows in the resistor R1 in the direction which is the same as the flowing direction of the drive current. As a result, an induced voltage signal VRs is generated in the resistor R1. The comparator Q7 compares the induced voltage signal VRs and the reference voltage Vcomp with each other for each of the sections T1, T2 and T3. In a case where the induced voltage signal VRs is equal to or smaller than the reference voltage Vcomp, the comparator Q7 outputs a signal indicating "1". In a case where the induced voltage signal VRs is greater than the reference voltage Vcomp, the comparator Q7 outputs a signal indicating "0". As will be described later with reference to FIG. 6, the section T1 is a first section in the detection section. The section T2 is a second section in the detection section. The section T3 is a third section in the detection section.

During a period of times t3 to t5 in FIG. 3, a second drive pulse is generated. In this manner, in the drive section, the pulse control unit 11 switches the switching elements Q4 and Q2 between the ON-state and the OFF-state at a predetermined cycle in response to the main drive pulse P1. In this manner, the pulse control unit 11 controls the motor 20 to be rotated in the forward direction. During this period, the switching elements Q1, Q5, and Q6 are respectively in the OFF-state, and the switching element Q3 is in the ON-state.

In the detection section, the pulse control unit 11 maintains the OFF-state of the switching element Q2, switches the switching element Q4 between the ON-state and the OFF-state at a predetermined timing, and controls the switching element Q4 to be in a high-impedance state. In the detection section, the pulse control unit 11 controls the switching element Q6 to be switched to the ON-state. During the detection period, the pulse control unit 11 maintains the ON-state of the switching element Q3, and controls the switching elements Q1 and Q5 to be in the OFF-state. In this manner, the induced current flows in the resistor R2 in the direction which is the same as the flowing direction of the drive current. As a result, the induced voltage signal VRs is generated in the resistor R2. The comparator Q7 compares the induced voltage signal VRs and the reference voltage Vcomp with each other for each section of the sections T1, T2, and T3. In a case where the induced voltage signal VRs is equal to or smaller than the reference voltage Vcomp, the comparator Q7 outputs the signal indicating "1". In a case where the induced voltage signal VRs is greater than the reference voltage Vcomp, the comparator Q7 outputs the signal indicating "0".

Next, a relationship between a load state of the drive load and the induced voltage will be further described with reference to FIG. 6.

Figure 6:
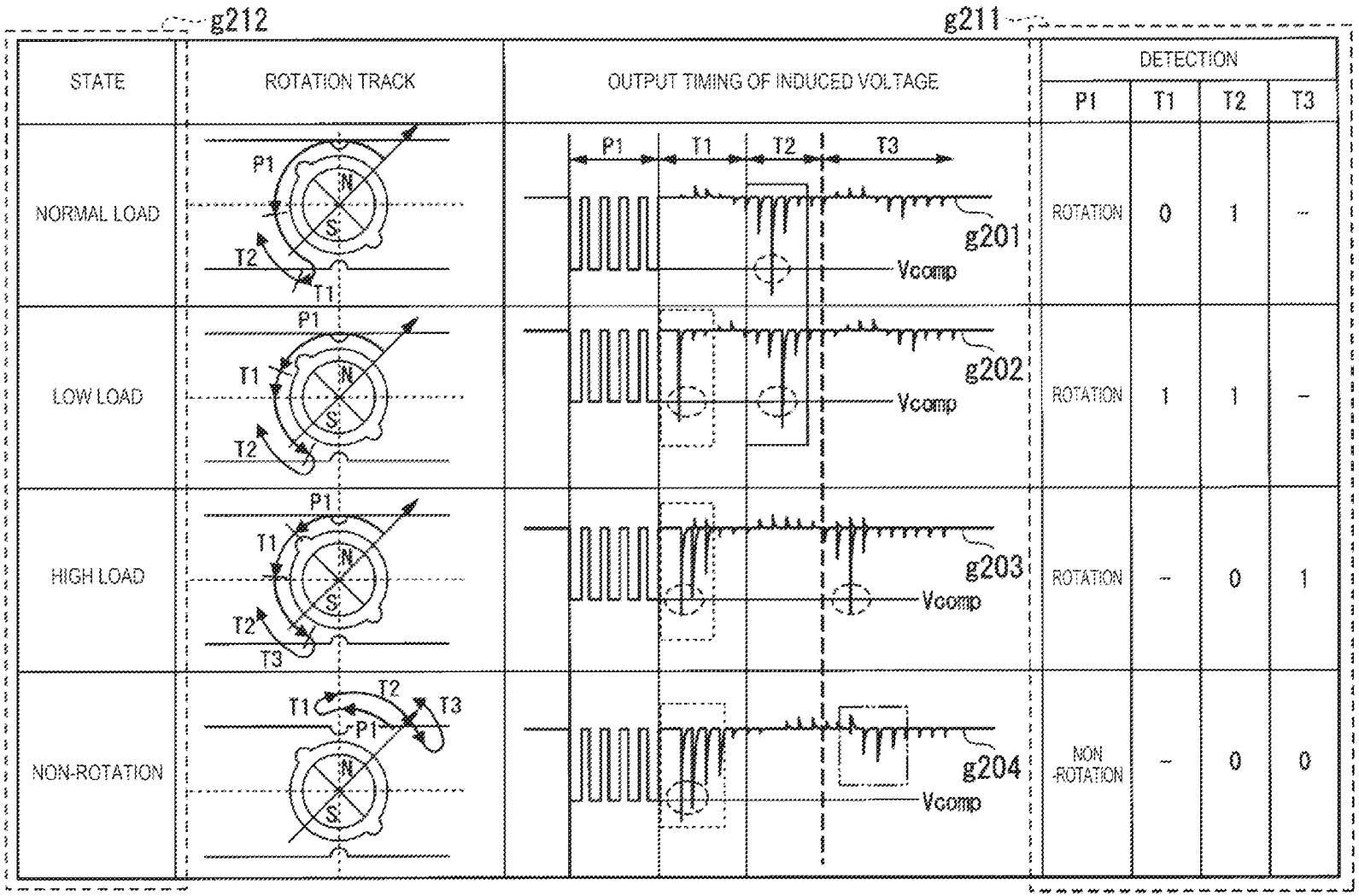
FIG. 6 is a view for describing a relationship between a load state and the induced voltage according to the embodiment.

FIG. 6 is a view for describing the relationship between the load state of the drive load and the induced voltage according to the embodiment. In FIG. 6, a reference numeral P1 indicates the drive pulse P1. A reference numeral T1 indicates the section T1. A reference numeral T2 indicates the section T2. A reference numeral T3 indicates the section T3. Waveforms g201 to g204 show a schematic combination between a signal CO1 input to the comparator Q7 and the drive pulse P1.

In a case where the drive load is normal (normal load), as illustrated by the waveform g201, in the section T2, the induced voltage signal VRs is equal to or greater than the reference voltage Vcomp. Therefore, an output of the comparator Q7 is "0" in the section T1, "1" in the section T2, and "-" in the section T3. Here, "-" indicates that the output may be "0" or may be "1".

In a case where the drive load is low (low load), as illustrated by the waveform g202, in the section T1 and the section T2, the induced voltage signal VRs is equal to or greater than the reference voltage Vcomp. Therefore, the output of the comparator Q7 is "1" in the section T1, "1" in the section T2, and "-" in the section T3.

In a case where the drive load is high (high load), as illustrated by the waveform g203, in the section T1 and the section T3, the induced voltage signal VRs is equal to or greater than the reference voltage Vcomp. Therefore, the output of the comparator Q7 is "-" in the section T1, "0" in the section T2, and "1" in the section T3.

In a case where the motor 20 cannot be rotated (non-rotation), as illustrated by the waveform g204, in the section T1, the induced voltage signal VRs is equal to or greater than the reference voltage Vcomp. Therefore, the output of the comparator Q7 is "-" in the section T1, "0" in the section T2, and "0" in the section T3.

In a case where a non-rotation state is detected at the main drive pulse P1, the pulse control unit 11 controls the motor 20 to be rotationally driven using the auxiliary drive pulse P2 having the polarity the same as that of the main drive pulse P1.

That is, it is possible to detect a state of the drive load or the non-rotation state by combining the outputs in the sections T1 to T3 of the comparator Q7 with each other.

The storage unit 5 stores data by associating the output of the comparator Q7 in the sections T1 to T3 in the region surrounded by a reference numeral g211 in FIG. 6 with the load state or the rotation state in the region surrounded by a reference numeral g212. The pulse control unit 11 detects fluctuations in the drive load, based on the output of the comparator Q7, and detects a reference position of the indicating hand (details to be described later).

Next, a configuration of the train wheel 30 will be described with reference to an example of the train wheel 30*b*.

Figure 7:
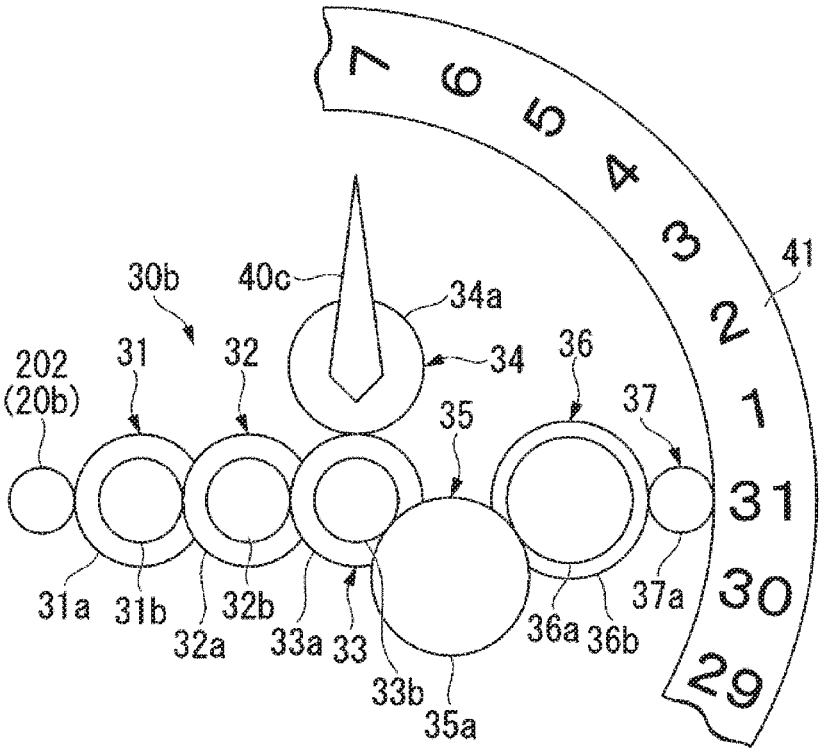
FIG. 7 is a plan view illustrating a train wheel according to the embodiment.
Figure 8:
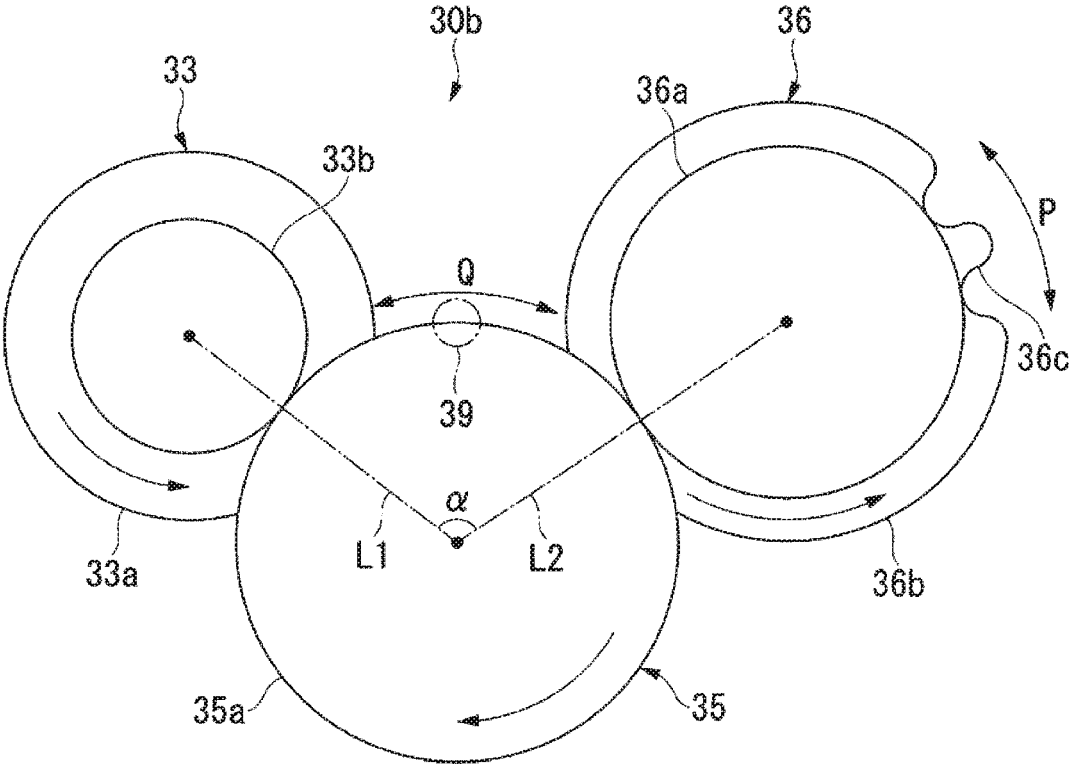
FIG. 8 is a plan view illustrating a portion of the train wheel according to the embodiment.

FIG. 7 is a plan view illustrating the train wheel according to the embodiment. FIG. 8 is a plan view illustrating a portion of the train wheel according to the embodiment.

As illustrated in FIGS. 7 and 8, the train wheel 30*b* includes a first intermediate wheel 31, a second intermediate wheel 32, a third intermediate wheel 33, an hour wheel 34, a fourth intermediate wheel 35, a fifth intermediate wheel 36, and a sixth intermediate wheel 37.

The first intermediate wheel 31 has a first intermediate gear 31*a* and a first intermediate pinion 31*b*. The first intermediate gear 31*a* meshes with a pinion of the rotor 202 of the second motor 20*b*. The second intermediate wheel 32 has a second intermediate gear 32*a* and a second intermediate pinion 32*b*. The second intermediate gear 32*a* meshes with the first intermediate pinion 31*b* of the first intermediate wheel 31. The third intermediate wheel 33 has a third intermediate gear 33*a* and a third intermediate pinion 33*b* (second gear). The third intermediate gear 33*a* meshes with the second intermediate pinion 32*b* of the second intermediate wheel 32. The hour wheel 34 has an hour gear 34*a*. The hour gear 34*a* meshes with the third intermediate gear 33*a* of the third intermediate wheel 33. The third indicating hand 40*c* is attached to the hour wheel 34. The hour wheel 34 is rotated once in 12 hours.

The fourth intermediate wheel 35 has a fourth intermediate gear 35*a* (first gear). The fourth intermediate gear 35*a* meshes with the third intermediate pinion 33*b* of the third intermediate wheel 33. The fourth intermediate wheel 35 is rotated once each time the hour wheel 34 is rotated twice. That is, the fourth intermediate wheel 35 is rotated once in 24 hours. The fifth intermediate wheel 36 has a fifth intermediate gear 36*a* (third gear) and a disc wheel 36*b*. The fifth intermediate gear 36*a* meshes with the fourth intermediate gear 35*a* of the fourth intermediate wheel 35. The disc wheel 36*b* includes a differential gear 36*c*. The differential gear 36*c* protrudes outward in a radial direction from an outer peripheral surface of the disc wheel 36*b*. The fifth intermediate wheel 36 is rotated once in 24 hours.

The sixth intermediate wheel 37 (intermittent operation unit) includes a sixth intermediate gear 37*a*. The sixth intermediate gear 37*a* meshes with the differential gear 36*c* of the disc wheel 36*b* of the fifth intermediate wheel 36 and a tooth (not illustrated) disposed in an inner periphery of the display wheel 41. The sixth intermediate wheel 37 meshes once with the differential gear 36*c* of the fifth intermediate wheel 36 each time the fifth intermediate wheel 36 is rotated once, and is rotated as much as a predetermined angle. The sixth intermediate wheel 37 is rotated only within a partial period during which the differential gear 36*c* is located in a date changing region P, within a period during which the fifth intermediate wheel 36 is rotated once. The sixth intermediate wheel 37 rotates the display wheel 41 each time the sixth intermediate wheel 37 is rotated as much as a predetermined angle. In this manner, the sixth intermediate wheel 37 and the display wheel 41 are intermittently operated relative to the rotation of the rotor 202 and the fourth intermediate wheel 35 by the rotation of the rotor 202. The display wheel 41 performs a date changing operation each time the sixth intermediate wheel 37 is rotated as much as a predetermined angle. That is, the display wheel 41 performs the date changing operation during only the partial period. The date changing operation is an operation to change the date displayed by the timepiece 1.

As illustrated in FIG. 8, a first line segment L1 which connects a rotation center of the fourth intermediate wheel 35 and a rotation center of the third intermediate wheel 33 to each other in a plan view when viewed in a direction of a rotation axis of the fourth intermediate wheel 35 is set to form an angle $\alpha$ smaller than 180° with a second line segment L2 which connects a rotation center of the fourth intermediate wheel 35 and a rotation center of the fifth intermediate wheel 36 to each other. In other words, the first line segment L1 is shifted from the second line segment L2 as much as the angle $\alpha$ smaller than 180° around the rotation center of the fourth intermediate wheel 35. That is, the angle formed between the first line segment L1 and the second line segment L2 is not 180°, and the first line segment L1 and the second line segment L2 do not form a straight line. Hereinafter, a region whose central angle is the angle at which is interposed between the first line segment L1 and the second line segment L2 in a plan view around the rotation center of the fourth intermediate wheel 35 will be referred to as an interposed region. The first line segment L1 is located in an upstream side end portion of the interposed region in the forward rotation direction (arrow direction in the drawing) of the fourth intermediate wheel 35. The second line segment L2 is located in a downstream side end portion of the interposed region in the forward rotation direction of the fourth intermediate wheel 35.

Here, the above-described reference load unit 39 will be further described.

The train wheel 30*b* has the reference load unit 39. The reference load unit 39 is disposed so that the drive load increases when the at least third indicating hand 40*c* is located at the reference position. The reference load unit 39 is disposed in the fourth intermediate gear 35*a*. The reference load unit 39 is configured so that one tooth of the fourth intermediate gear 35*a* has a shape which is different from that of other teeth. In this manner, while the fourth intermediate wheel 35 is rotated once, the reference load unit 39 meshes twice with the third intermediate pinion 33*b* and the fifth intermediate gear 36*a*, and increases the drive load. That is, the drive load increases when the reference load unit 39 of the fourth intermediate gear 35*a* passes through the first line segment L1 or the second line segment L2 in a plan view. In the present embodiment, the reference load unit 39 is disposed to mesh with the third intermediate pinion 33*b* when the third indicating hand 40*c* is located at the reference position. Hereinafter, a rotation position of the fourth intermediate wheel 35 in a case where the reference load unit 39 meshes with the third intermediate pinion 33*b* will be referred to as a reference load position. When the fourth intermediate wheel 35 is located at the reference load position, the third indicating hand 40*c* is located at the reference position.

The fifth intermediate wheel 36 increases the drive load when the sixth intermediate wheel 37 is rotated. That is, the fifth intermediate wheel 36 increases the drive load once each time the fourth intermediate wheel 35 is rotated once. When the differential gear 36*c* of the fifth intermediate wheel 36 is located in the date changing region P, the reference load unit 39 of the fourth intermediate wheel 35 is located in a date changing load generating region Q which is a portion of the interposed region. The fifth intermediate wheel 36 is disposed to rotate the sixth intermediate wheel 37 within a partial period during which the reference load unit 39 of the fourth intermediate wheel 35 is located in the interposed region. In this manner, the train wheel 30*b* increases the drive load due to the date changing operation in the partial period during which the reference load unit 39 of the fourth intermediate wheel 35 is located in the interposed region, within the period during which the fourth intermediate wheel 35 is rotated once.

The central angle α of the interposed region is smaller than the rotation angle of the fourth intermediate wheel 35 in the period during which the drive load increases due to the date changing operation. In other words, the central angle α of the interposed region is larger than the rotation angle of the fourth intermediate wheel 35 in the period during which the reference load unit 39 of the fourth intermediate wheel 35 is located in the date changing load generating region Q. Furthermore, the central angle α of the interposed region is larger than a sum of the rotation angle of the fourth intermediate wheel 35 in the period during which the drive load increases due to the date changing operation and the rotation angle corresponding to two teeth of the fourth intermediate gear 35*a*.

Figure 9:
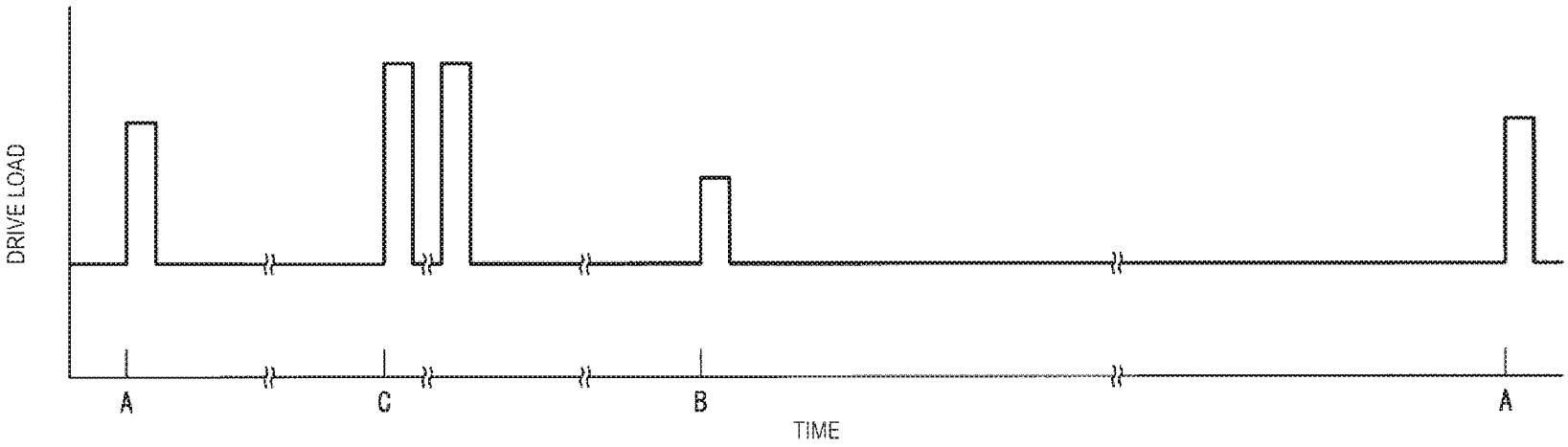
FIG. 9 is a view illustrating fluctuations in a drive load according to the embodiment.

FIG. 9 is a view illustrating fluctuations in the drive load according to the embodiment. In FIG. 9, the horizontal axis represents a time, and the vertical axis represents the drive load.

As illustrated in FIG. 9, the drive load increases at each of timings A, B, and C while the fourth intermediate wheel 35 is rotated once. The timing A indicates a timing at which the reference load unit 39 of the fourth intermediate wheel 35 meshes with the third intermediate pinion 33*b*. The timing B indicates a timing at which the reference load unit 39 of the fourth intermediate wheel 35 meshes with the fifth intermediate gear 36*a*. The timing C indicates a timing at which the date changing operation is performed. That is, the timing C indicates a timing at which the sixth intermediate wheel 37 and the display wheel 41 are rotated. A period from the timing A to the timing B indicates a period during which the reference load unit 39 of the fourth intermediate wheel 35 passes through the interposed region. A period from the timing B to the timing C indicates a period during which the reference load unit 39 of the fourth intermediate wheel 35 passes through the outside of the interposed region. The number of drive steps of the motor 20 from the timing B to the timing A is more than the number of drive steps of the motor 20 from the timing A to the timing B. Specifically, the number of drive steps of the motor 20 from the timing B to the timing A is the number of drive steps of the motor 20 which is required for rotating the fourth intermediate wheel 35 as much as 180° or larger. In the illustrated example, an increase in the drive load which is caused by the date changing operation at the timing C has two peaks, but the configuration is not limited thereto. A magnitude of the drive load which increases at the timings A, B, and C is not limited to the illustrated example.

Next, a processing procedure of detecting a position where the reference load unit 39 of the fourth intermediate wheel 35 meshes with the third intermediate pinion 33*b* (hereinafter, referred to as a reference load position) will be described with reference to FIG. 10.

Figure 10:
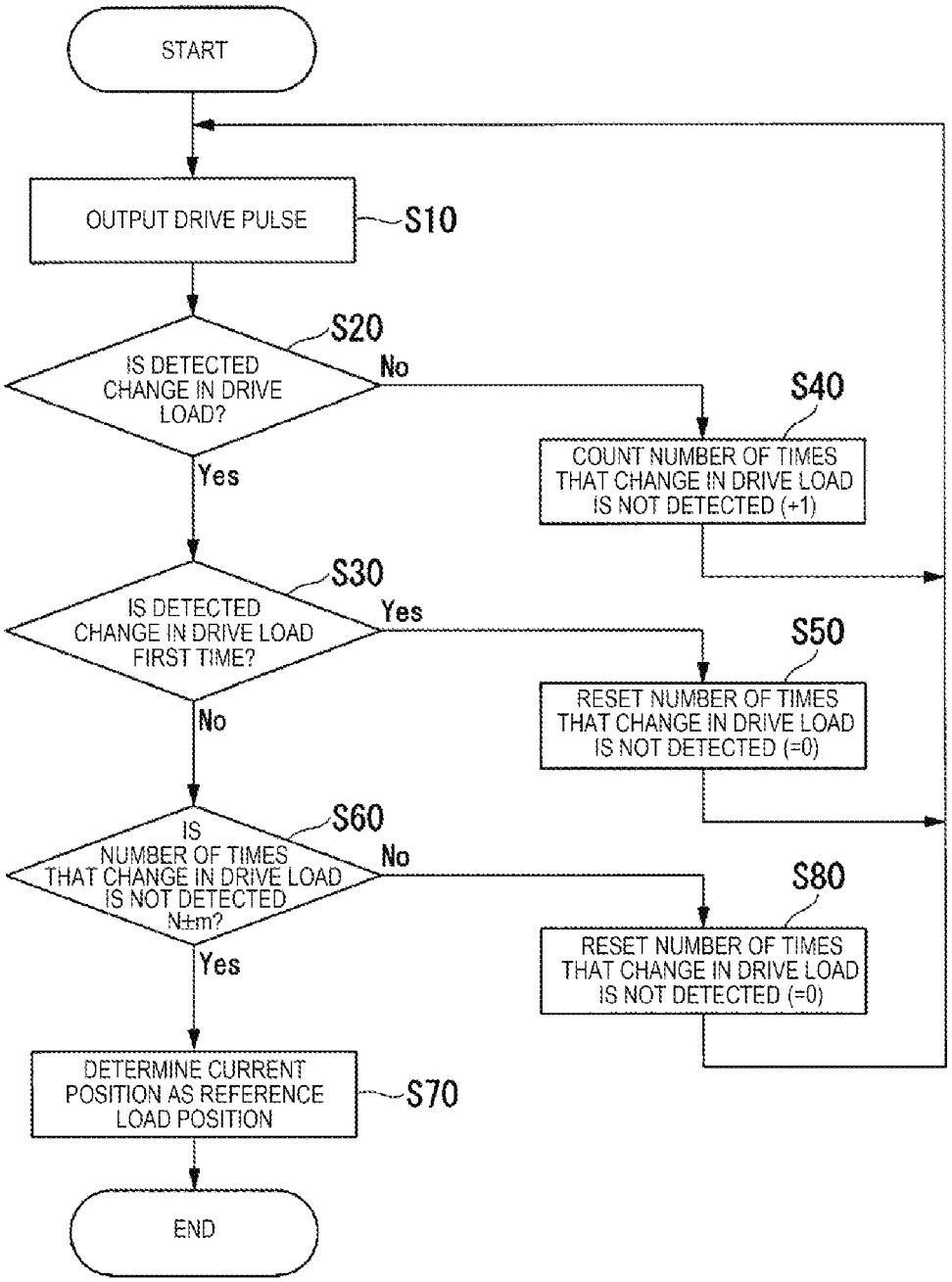
FIG. 10 is a flowchart illustrating a processing procedure example of detecting a reference load position according to the embodiment.

FIG. 10 is a flowchart illustrating a processing procedure example for detecting the reference load position according to the embodiment.

In Step S10, the pulse control unit 11 outputs a drive pulse. Subsequently, the pulse control unit 11 proceeds to a process in Step S20.

In Step S20, the pulse control unit 11 determines whether or not an increase in the drive load is detected. In a case where the pulse control unit 11 determines that the increase in the drive load is detected (S20: Yes), the pulse control unit 11 proceeds to a process in Step S30. In a case where the pulse control unit 11 determines that the increase in the drive load is not detected (S20: No), the pulse control unit 11 proceeds to a process in Step S40.

In Step S30, the pulse control unit 11 determines whether or not an increase in the drive load is detected first time. In a case where the pulse control unit 11 determines that the increase in the drive load is detected first time (S30: Yes), the pulse control unit 11 proceeds to a process in Step S50. In a case where the pulse control unit 11 determines that the increase in the drive load is not detected first time (S30: No), that is, in a case where the increase in the drive load is detected more than second time, the pulse control unit 11 proceeds to a process in Step S60.

In Step S40, the pulse control unit 11 counts the number of times that the increase in the drive load is not detected, and stores the count number in the storage unit 5. Subsequently, the pulse control unit 11 performs the process in Step S10 again.

In Step S50, the pulse control unit 11 resets the count number stored in the storage unit 5. Subsequently, the pulse control unit 11 performs the process in Step S10 again.

In Step S60, the pulse control unit 11 determines whether or not the count number stored in the storage unit 5 corresponds to a preset count number N. The count number N indicates the number of drive steps of the motor 20 which is required for the reference load unit 39 of the fourth intermediate wheel 35 to enter the interposed region again after retreating from the interposed region. That is, the count number N is the number of drive steps of the motor 20 from the timing B to the timing A which are illustrated in FIG. 9. In a case where the count number stored in the storage unit 5 corresponds to the count number N, the increase in the drive load detected immediately before is caused by meshing between the reference load unit 39 of the fourth intermediate wheel 35 and the third intermediate pinion 33*b*. In a case where the count number stored in the storage unit 5 does not correspond to the count number N, the increase in the drive load detected immediately before is caused by meshing between the reference load unit 39 of the fourth intermediate wheel 35 and the fifth intermediate gear 36*a* or the date changing operation.

Here, the count number stored in the storage unit 5 may not completely coincide with the preset count number N in some cases. For example, the motor 20 needs to be driven multiple steps from the start to the release of the meshing between the reference load unit 39 of the fourth intermediate wheel 35 and the third intermediate pinion 33*b* or the fifth intermediate gear 36*a*. Therefore, in Step S60 according to the present embodiment, the pulse control unit 11 sets the count number N to have a predetermined width m, and determines whether or not the count number stored in the storage unit 5 coincides with a count number N±m. In a case where the pulse control unit 11 determines that the count number stored in the storage unit 5 coincides with the count number N±m (S60: Yes), the pulse control unit 11 proceeds to a process in Step S70. In a case where the pulse control unit 11 determines that the count number stored in the storage unit 5 does not coincide with the count number N±m (S60: No), the pulse control unit 11 proceeds to a process in Step S80.

In Step S70, the pulse control unit 11 determines the current rotation position of the fourth intermediate wheel 35 as the reference load position, and completes the process.

In Step S80, the count number stored in the storage unit 5 is reset. Subsequently, the pulse control unit 11 performs the process in Step S10 again.

According to the above-described processes, the pulse control unit 11 can detect the reference load position, based on fluctuations in the drive load when the reference load unit 39 of the fourth intermediate wheel 35 enters the interposed region.

Next, a processing procedure of causing the storage unit 5 to store a relationship between the reference load position and the reference position of the third indicating hand 40*c* will be described with reference to FIG. 11.

Figure 11:
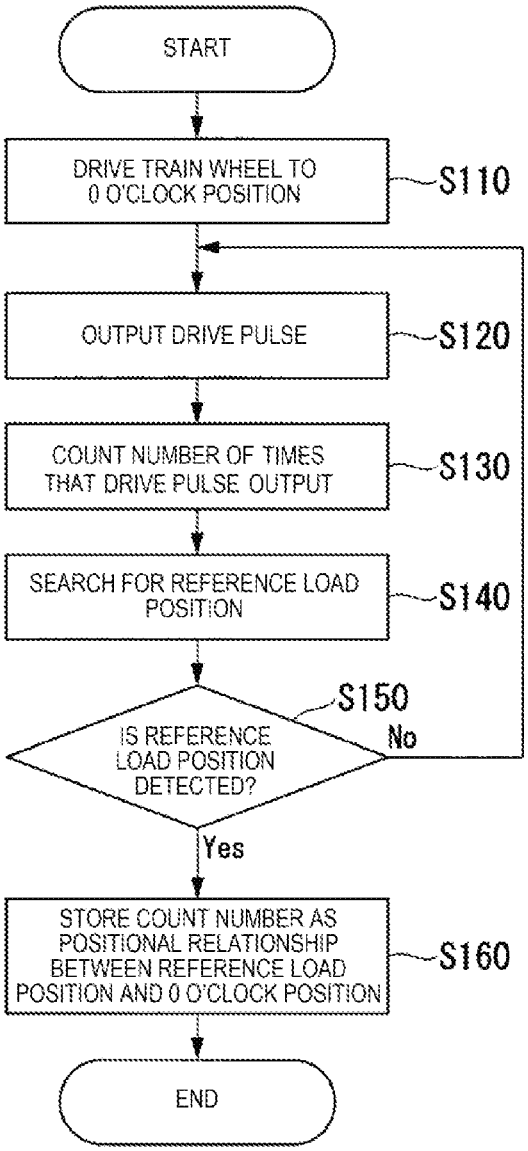
FIG. 11 is a flowchart illustrating a processing procedure example of causing a storage unit to store a relationship between the reference load position and a reference position of an indicating hand according to the embodiment.

FIG. 11 is a flowchart illustrating a processing procedure example of causing the storage unit to store the relationship between the reference load position and the reference position of the indicating hand according to the embodiment.

In Step S110, the train wheel 30*b* is driven to a 0 o'clock position. The 0 o'clock position is a position where the third indicating hand 40*c* indicates 0 o'clock and the display wheel 41 performs the date changing operation. The pulse control unit 11 outputs the drive pulse, and drives the train wheel 30*b* so that the train wheel 30*b* is located at the 0 o'clock position. Next, the pulse control unit 11 proceeds to a process in Step S120.

In Step S120, the pulse control unit 11 outputs the drive pulse once. Subsequently, the pulse control unit 11 proceeds to a process in Step S130.

In Step S130, the pulse control unit 11 counts the number of times that the drive pulse is output, and stores the count number in the storage unit 5. Subsequently, the pulse control unit 11 proceeds to a process in Step S140.

In Step S140, the pulse control unit 11 searches for the reference load position. Subsequently, the pulse control unit 11 proceeds to a process in Step S150.

In Step S150, the pulse control unit 11 determines whether or not the reference load position can be detected. In a case where the pulse control unit 11 detects the reference load position, the third indicating hand 40*c* is located at the reference position. In a case where the pulse control unit 11 determines that the reference load position can be detected (S150: Yes), the pulse control unit 11 proceeds to a process in Step S160. In a case where the pulse control unit 11 determines that the reference load position cannot be detected (S150: No), the pulse control unit 11 performs the process in Step S120 again. The process from Step S120 to Step S150 corresponds to those in which the process in Step S130 is added to the above-described process of detecting the reference load position.

In Step S160, the pulse control unit 11 causes the storage unit 5 to store the count number stored in the storage unit 5 as information on the rotation position of the third indicating hand 40*c* which is the reference position, and completes the processes. The information on the rotation position is the number of drive steps of the motor 20 which is required for rotating the third indicating hand 40*c* from the 0 o'clock position to the reference position.

According to the above-described processes, the storage unit 5 can store the information on the position (reference position) of the third indicating hand 40*c* when the drive load fluctuates due to the reference load unit 39. Based on the information on the position of the third indicating hand 40*c* which is stored in the storage unit 5, the pulse control unit 11 can detect the position indicated by the third indicating hand 40*c* when the fluctuations in the drive load are detected. Specifically, the pulse control unit 11 detects the reference load position. In this manner, based on the information on the position of the third indicating hand 40*c* which is stored in the storage unit 5, the reference position of the third indicating hand 40*c* can be detected.

Subsequently, a processing procedure of detecting the 0 o'clock position will be described with reference to FIG. 12.

Figure 12:
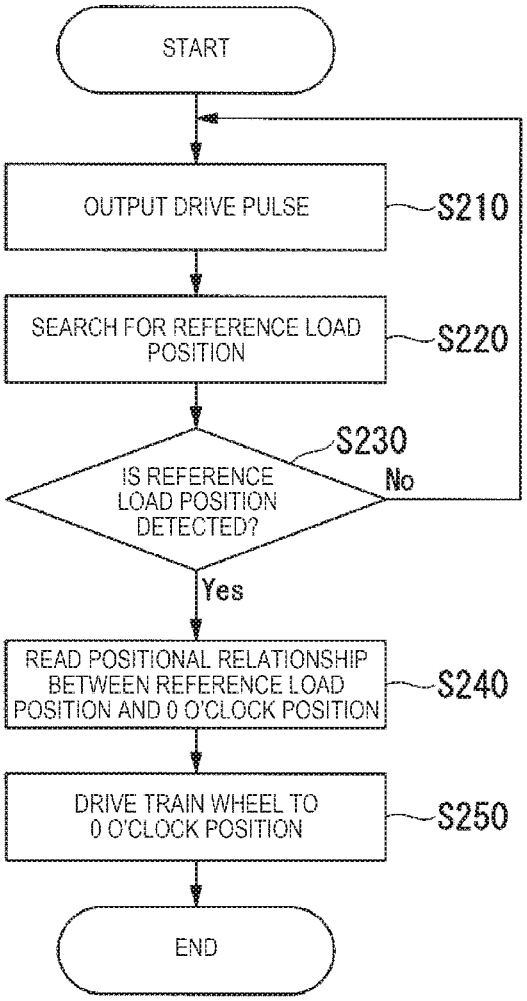
FIG. 12 is a flowchart illustrating a processing procedure example of detecting a 0 o'clock position according to the embodiment.

FIG. 12 is a flowchart illustrating a processing procedure example of detecting the 0 o'clock position according to the embodiment.

In Step S210, the pulse control unit 11 outputs the drive pulse once. Subsequently, the pulse control unit 11 proceeds to a process in Step S220.

In Step S220, the pulse control unit 11 searches for the reference load position. Subsequently, the pulse control unit 11 proceeds to a process in Step S230.

In Step S230, the pulse control unit 11 determines whether or not the reference load position can be detected. In a case where the pulse control unit 11 detects the reference load position, the third indicating hand 40*c* is located at the reference position. In a case where the pulse control unit 11 determines that the reference load position can be detected (S230: Yes), the pulse control unit 11 proceeds to a process in Step S240. In a case where the pulse control unit 11 determines that the reference load position cannot be detected (S230: No), the pulse control unit 11 performs the process in Step S210 again. The process from Step S210 to Step S230 corresponds to the above-described process of detecting the reference load position.

In Step S240, the pulse control unit 11 reads the information on the position of the above-described third indicating hand 40*c* from the storage unit 5. Subsequently, the pulse control unit 11 proceeds to a process in Step S250.

In Step S250, the pulse control unit 11 moves the train wheel 30*b* to the 0 o'clock position. Based on the information on the position of the above-described third indicating hand 40*c*, the pulse control unit 11 calculates the number of drive steps of the motor 20 which is required for moving the third indicating hand 40*c* from the reference position to the position indicating 0 o'clock, and drive the motor 20 as much as the calculated number of steps.

According to the above-described processes, the third indicating hand 40*c* can be moved to the 0 o'clock position.

As described above, according to the present embodiment, the fourth intermediate gear 35*a* has the reference load unit 39 that causes the fluctuations in the drive load in each case of meshing with the third intermediate pinion 33*b* and the fifth intermediate gear 36*a*. In a plan view, the first line segment L1 which connects the rotation center of the fourth intermediate gear 35*a* and the rotation center of the third intermediate pinion 33*b* to each other is set to form the angle $\alpha$ smaller than 180° with the second line segment L2 which connects the rotation center of the fourth intermediate gear 35*a* and the rotation center of the fifth intermediate gear 36*a* to each other.

According to this configuration, the number of drive steps of the motor 20 which is required for the reference load unit 39 to move from a position for meshing with the third intermediate pinion 33*b* to a position for meshing with the fifth intermediate gear 36*a* is different from the number of drive steps of the motor 20 which is required for the reference load unit 39 to move from a position for meshing with the fifth intermediate gear 36*a* to a position for meshing with the third intermediate pinion 33*b*. Therefore, the motor 20 is driven one step by one step so as to determine the length of the period during which the drive load does not fluctuate. In this manner, it is possible to detect the position where the reference load unit 39 meshes with the third intermediate pinion 33*b* and the position where the reference load unit 39 meshes with the fifth intermediate gear 36*a*. Accordingly, the reference position of the third indicating hand 40*c* can be detected by associating the rotation position of the reference load unit 39 and the reference position of the third indicating hand 40*c* with each other.

The pulse control unit 11 detects the position of the reference load unit 39, based on the fluctuations in the drive load when the reference load unit 39 enters the interposed region.

According to this configuration, the length of the period during which the drive load does not fluctuate is determined. In this manner, the fluctuations in the drive load when the reference load unit 39 enters the interposed region can be easily detected by being distinguished from the fluctuations of the drive load when the reference load unit 39 retreats from the interposed region. Accordingly, the reference position of the third indicating hand 40*c* can be detected by associating the rotation position of the reference load unit 39 and the reference position of the third indicating hand 40*c* with each other.

The timepiece movement includes the storage unit 5 that stores the information on the position of the third indicating hand 40*c* when the drive load fluctuates due to the reference load unit 39.

According to this configuration, the pulse control unit 11 detects the position of the reference load unit 39 by detecting the fluctuations in the drive load. In this manner, based on the information stored in the storage unit 5, the position of the third indicating hand 40*c* can be detected.

Based on the information on the position of the third indicating hand 40*c* which is stored in the storage unit 5, the pulse control unit 11 detects the position indicated by the third indicating hand 40*c* when the fluctuations in the drive load are detected.

According to this configuration, it is possible to recognize the position indicated by the third indicating hand 40*c*. Therefore, the third indicating hand 40*c* can be moved to a desired position.

Based on the information on the position of the third indicating hand 40*c* which is stored in the storage unit 5, the pulse control unit 11 moves the third indicating hand 40*c* to the position indicating 0 o'clock.

According to this configuration, it is possible to accurately perform a resetting operation of the third indicating hand 40*c*.

The timepiece movement includes the sixth intermediate wheel 37 and the display wheel 41 which are intermittently operated relative to the rotation of the rotor 202 by the rotation of the rotor 202. The sixth intermediate wheel 37 and the display wheel 41 cause at least one fluctuation in the drive load due to the date changing operation each time the fourth intermediate gear 35*a* is rotated once. The at least one fluctuation occurs in a partial period during which the reference load unit 39 is located in the interposed region in a plan view within a period during which the fourth intermediate gear 35*a* is rotated once.

In a case where the fluctuation in the drive load occurs due to the date changing operation of the sixth intermediate wheel 37 and the display wheel 41 in the period during which the reference load unit 39 is located outside the interposed region in a plan view, there is a possibility that the fluctuation in the drive load may occur each time the fourth intermediate gear 35*a* is rotated smaller than 180°. In this case, it is difficult to determine whether the fluctuations in the drive load are caused by the reference load unit 39 or the date changing operation of the sixth intermediate wheel 37 and the display wheel 41. That is, it is difficult to detect the position where the reference load unit 39 meshes with the third intermediate pinion 33*b* and the position where the reference load unit 39 meshes with the fifth intermediate gear 36*a*.

According to the present embodiment, the drive load does not fluctuate while the reference load unit 39 passes through the outside of the interposed region in a plan view. The fourth intermediate gear 35*a* is rotated 180° or larger while the reference load unit 39 passes through the outside of the interposed region in a plan view. Therefore, the state where the drive load does not fluctuate even if the fourth intermediate gear 35*a* is rotated 180° or larger is determined. In this manner, the fluctuations in the drive load when the reference load unit 39 enters the interposed region can be easily detected by being distinguished from the fluctuations of the drive load when the reference load unit 39 retreats from the interposed region and the fluctuations in the drive load due to the date changing operation. Therefore, the reference position of the third indicating hand 40*c* can be detected.

The central angle $\alpha$ of the interposed region is larger than the rotation angle of the fourth intermediate gear 35*a* in a period during which the drive load fluctuates due to the date changing operation.

According to this configuration, it is possible to prevent the fluctuations in the drive load by the date changing operation of the sixth intermediate wheel 37 and the display wheel 41 from overlapping the fluctuations in the drive load by the reference load unit 39. Accordingly, it is possible to accurately detect the fluctuations in the drive load by the reference load unit 39.

Furthermore, the central angle $\alpha$ of the interposed region is larger than the sum of the rotation angle of the fourth intermediate gear 35*a* in the period during which the drive load fluctuates due to the date changing operation and the rotation angle corresponding to two teeth of the fourth intermediate gear 35*a*.

According to this configuration, when the train wheel 30*b* is assembled, the meshing position between the fourth intermediate gear 35*a* and the fifth intermediate gear 36*a* can be allowed to be shifted one tooth from a desired meshing position. Accordingly, it is possible to easily assemble the timepiece movement which can achieve the above-described operation effects.

The timepiece 1 according to the present embodiment includes the above-described timepiece movement. Therefore, it is possible to prevent misalignment of the third indicating hand 40*c* by properly detecting the reference position of the third indicating hand 40*c*.

The present invention is not limited to the embodiment described above with reference to the drawings, and it is conceivable to adopt various modification examples within the technical scope of the present invention.

For example, in the above-described embodiment, the timepiece 1 includes the date indicator (display wheel 41) that is intermittently operated relative to the rotation of the fourth intermediate wheel 35. However, the present invention is not limited thereto. For example, the timepiece may include a day indicator that is intermittently operated relative to the rotation of the fourth intermediate wheel 35.

In the above-described embodiment, the timepiece movement is configured to cause at least one fluctuation in the drive load by using the configuration (the sixth intermediate wheel 37 and the display wheel 41) other than the reference load unit 39 each time the fourth intermediate wheel 35 is rotated once. However, the present invention is not limited thereto. That is, the timepiece movement may be configured to cause two or more fluctuations in the drive load by using the configuration other than the reference load unit 39 each time the fourth intermediate wheel 35 is rotated once. Even in this case, it is desirable to adopt a configuration in which all of the fluctuations in the drive load by using the configuration other than the reference load unit 39 occur in a partial period during which the reference load unit 39 is located in the interposed region in a plan view.

Although not specifically described above in the embodiment, the timepiece movement may include a jumper that regulates the position of at least one of the sixth intermediate wheel 37 and the display wheel 41 in the rotation direction. In a case where the jumper is provided, a larger torque is required when operating the sixth intermediate wheel 37 and the display wheel 41. Therefore, the drive load further increases. Accordingly, the operation effects can be effectively achieved by the above-described embodiment.

In the above-described embodiment, the rotation position of the fourth intermediate wheel 35 in a case where the reference load unit 39 meshes with the third intermediate pinion 33*b* is set as the reference load position. However, the present invention is not limited thereto. That is, the rotation position of the fourth intermediate wheel 35 in a case where the reference load unit 39 meshes with the fifth intermediate gear 36*a* may be set as the reference load position. In this case, based on the load fluctuations when the reference load unit 39 enters the interposed region, the load fluctuations when the reference load unit 39 retreats from the interposed region are determined from the positional relationship between the first line segment L1 and the second line segment L2, and the reference load position is detected.

In the above-described embodiment, the first line segment L1 is set at a position shifted smaller than 180° on the upstream side in the forward rotation direction of the fourth intermediate wheel 35 from the second line segment L2. However, the present invention is not limited thereto. That is, the second line segment L2 may be set at a position shifted smaller than 180° on the upstream side in the forward rotation direction of the fourth intermediate wheel 35 from the first line segment L1.

In addition, the configuration elements in the above-described embodiments can be appropriately substituted with known configuration elements within the scope not departing from the gist of the present invention.

What is claimed is:

1. A timepiece movement comprising:

a stepping motor that has a rotor for rotating an indicating hand;

a control unit that rotates the rotor by using a main drive pulse and an auxiliary drive pulse, and that determines a reference position of the indicating hand by detecting a rotation state of the rotor when the indicating hand is rotated using a detection drive pulse based on the main drive pulse; and a train wheel that transmits a drive force of the stepping motor to the indicating hand, and that has a first gear, and a second gear and a third gear which mesh with the first gear, wherein the first gear has a reference load unit that causes fluctuations in a load applied to the rotor in each case where the first gear meshes with the second gear and the third gear, and wherein a first line segment which connects a rotation center of the first gear and a rotation center of the second gear to each other in a plan view is set to form an angle smaller than 180° with a second line segment which connects the rotation center of the first gear and a rotation center of the third gear to each other in a plan view.

2. The timepiece movement according to claim 1, further comprising:

an intermittent operation unit that intermittently operates the first gear to rotate by rotating the rotor, wherein the intermittent operation unit causes at least one fluctuation in the load applied to the rotor each time the first gear rotates once, and wherein the at least one fluctuation occurs in a portion of a period during which the reference load unit is located in a region interposed between the first line segment and the second line segment in a plan view.

3. The timepiece movement according to claim 2, wherein the intermittent operation unit includes a date indicator that performs a date changing operation.

4. The timepiece movement according to claim 1, wherein a central angle of a region interposed between the first line segment and the second line segment in a plan view is larger than a rotation angle of the first gear during a period during which at least one fluctuation occurs.

5. The timepiece movement according to claim 4, wherein the central angle of the region interposed between the first line segment and the second line segment in a plan view is larger than a sum of the rotation angle of the first gear during the period during which the at least one fluctuation occurs and a rotation angle corresponding to two teeth of the first gear.

6. The timepiece movement according to claim 1, wherein the control unit detects a position of the reference load unit, based on the fluctuations of the load applied to the rotor when the reference load unit enters a region interposed between the first line segment and the second line segment in a plan view.

7. The timepiece movement according to claim 1, further comprising:

a storage unit that stores information on a position of the indicating hand when the reference load unit causes the fluctuations in the load applied to the rotor.

8. The timepiece movement according to claim 7, wherein based on the information on the position of the indicating hand which is stored in the storage unit, the control unit detects a position indicated by the indicating hand when the fluctuations in the load applied to the rotor are detected.

9. The timepiece movement according to claim 8, wherein based on the information on the position of the indicating hand which is stored in the storage unit, the control unit moves the indicating hand to a position indicating 0 o'clock.

10. A timepiece comprising:

the timepiece movement according to claim 1.

* * * * *